US006424088B1

(12) United States Patent
Murasko

(10) Patent No.: US 6,424,088 B1
(45) **Date of Patent: *Jul. 23, 2002**

(54) ELECTROLUMINESCENT SIGN

(75) Inventor: Matthew M. Murasko, Manhattan Beach, CA (US)

(73) Assignee: Lumimove, Inc., Fenton, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,994

(22) Filed: Sep. 21, 2000

Related U.S. Application Data

(62) Division of application No. 08/905,528, filed on Aug. 4, 1997, now Pat. No. 6,203,391.

(51) Int. Cl.[7] ..... H01J 1/62
(52) U.S. Cl. ..... 313/506; 40/544
(58) Field of Search ..... 445/24, 58; 313/506; 40/544

(56) References Cited

U.S. PATENT DOCUMENTS

| | | | | | |
|---|---|---|---|---|---|
| 4,904,901 | A | * | 2/1990 | Simopoulos et al. | 313/509 |
| 5,051,654 | A | * | 9/1991 | Nativi et al. | 313/506 |
| 5,491,377 | A | * | 2/1996 | Janusauskas | 313/506 |
| 5,667,417 | A | * | 9/1997 | Stevenson | 445/24 |
| 5,856,031 | A | * | 1/1999 | Burrows | 313/506 |

* cited by examiner

*Primary Examiner*—Kenneth J. Ramsey
(74) *Attorney, Agent, or Firm*—Lathrop & Gage LC

(57) ABSTRACT

Signs including electroluminescent lamps are described. In accordance with one embodiment of the present invention, electroluminescent lamps are coupled to a sign by first forming a rear electrode on a front surface of the sign. After forming the rear electrode on the sign, a dielectric layer is screen printed over the rear electrode, and a phosphor layer is screen printed over the dielectric layer. A layer of indium tin oxide ink is then screen printed to the phosphor layer to form an EL lamp.

4 Claims, 5 Drawing Sheets

ELECTROLUMINESCENT SIGN

CROSS-REFERENCE TO RELATED APPLICATION

This application is a divisional of application Ser. No. 08/905,528 filed Aug. 4, 1997, now U.S. Pat. No. 6,203,391, the contents of which are incorporated herein by reference.

FIELD OF THE INVENTION

This invention relates generally to electroluminescent lamps and, more particularly, to display signs including such lamps.

BACKGROUND OF THE INVENTION

An electroluminescent (EL) lamp generally includes a layer of phosphor positioned between two electrodes, and at least one of the electrodes is light-transmissive. At least one dielectric also is positioned between the electrodes so the EL lamp functions essentially as a capacitor. When a voltage is applied across the electrodes, the phosphor material is activated and emits a light.

EL lamps typically are manufactured as discrete cells on either rigid or flexible substrates. One known method of fabricating an EL lamp includes the steps of applying a coating of light-transmissive conductive material, such as indium tin oxide, to a rear surface of polyester film, applying a phosphor layer to the conductive material, applying at least one dielectric layer to the phosphor layer, applying a rear electrode to the dielectric layer, and applying an insulating layer to the rear electrode. The various layers may, for example, be laminated together utilizing heat and pressure. Alternatively, the various layers may be screen printed to each other. When a voltage is applied across the indium tin oxide and the rear electrode, the phosphor material is activated and emits a light which is visible through the polyester film.

Typically, it is not desirable for the entire EL polyester film to be light emitting. For example, if an EL lamp is configured to display a word, it is desirable for only the portions of the EL polyester film corresponding to letters in the word to be light emitting. Accordingly, the indium tin oxide is applied to the polyester film so that only the desired portions of the film will emit light. For example, the entire polyester film may be coated with indium tin oxide, and portions of the indium tin oxide may then be removed with an acid etch to leave behind discrete areas of illumination. Alternatively, an opaque ink may be printed on a front surface of the polyester film to prevent light from being emitted through then entire front surface of the film.

Fabricated EL lamps often are affixed to products, e.g., signs, and watches, to provide lighting for such products. For example, EL lamps typically are utilized to provide illuminated images on display signs. Particularly, and with respect to a display sign, EL lamps are bonded to the front surface of the display sign so that the light emitted by the phosphor layers of such lamps may be viewed from a position in front of the sign.

Utilizing prefabricated EL lamps to form an illuminated display sign is tedious. Particularly, each EL lamp must be formed as a reverse image. For example, when utilizing an EL lamp to display an illuminated word, e.g., "THE", it is important that the word be accurate, i.e., be readable from left to right, when viewed from the front of the sign. Accordingly, and until now, it was necessary to apply the indium tin oxide to the polyester film as a reverse image, e.g., as a reverse image of "THE". The subsequent layers of phosphor, dielectric, and rear electrode then are similarly applied as reverse images. In addition, it is possible that the EL lamp may become damaged while bonding the EL lamp to the sign.

Accordingly, it would be desirable to provide a method for fabricating an illuminated sign having EL lamps which does not require coupling prefabricated EL lamps to the sign. It also would be desirable for such method to facilitate applying the various layers of the EL lamps to the EL substrate as a forward image, rather than a reverse image.

SUMMARY OF THE INVENTION

These and other objects may be attained by a sign which, in one embodiment, includes an electroluminescent lamp formed integrally therewith. Particularly, the electroluminescent lamp is formed on the sign by utilizing the sign as a substrate for the EL lamp. More specifically, and in the one embodiment, the sign is fabricated by utilizing the steps of screen printing a rear electrode to a front surface of the sign, screen printing at least one dielectric layer over the rear electrode after screen printing the rear electrode to the sign, screen printing a phosphor layer over the dielectric layer to define a desired area of illumination, screen printing a layer of indium tin oxide ink to the phosphor layer, screen printing a background layer of ink onto the sign so that the background layer substantially surrounds the desired area of illumination, and applying a protective coat over the indium tin oxide ink and background layer. More specifically, rather than coupling separate EL lamps to the sign, the rear electrode of each lamp is screen printed directly to the front surface of the sign, and the other layers of the EL lamp are screen printed over the rear electrode.

The above described method provides an illuminated sign having EL lamps but does not require coupling prefabricated EL lamps to the sign. Such method also facilitates applying the various layers of the EL lamps to the EL substrate as a forward image, rather than a reverse image.

DETAILED DESCRIPTION

Figure 1:
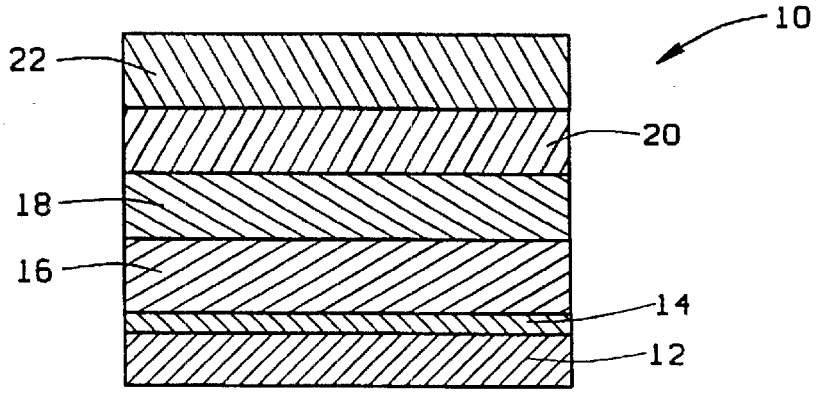
FIG. 1 is a schematic illustration of a known electroluminescent lamp.

FIG. 1 is a schematic illustration of a known electroluminescent (EL) lamp 10 including a substrate 12, a front electrode of conductive particles 14, a phosphor layer 16, a dielectric layer 18, a rear electrode of conductive particles 20, and a protective coating layer 22. Substrate 12 and front electrode 14 may, for example, be a polyester film coated with indium tin oxide, respectively. Phosphor layer 16 may be formed of electroluminescent phosphor particles, e.g., zinc sulfide doped with copper or manganese which are dispersed in a polymeric binder. Dielectric layer 18 may be formed of high dielectric constant material, such as barium titanate dispersed in a polymeric binder. Rear electrode of conductive particles 20 is formed of conductive particles, e.g., silver or carbon, dispersed in a polymeric binder to form a screen printable ink. Protective coating 22 may, for example, be an ultraviolet (UV) coating such as U.V. Clear available from Polymetric Imaging, Inc., North Kansas City, Mo. EL lamp 10 and the constituent layers thereof are well known.

Figure 2:
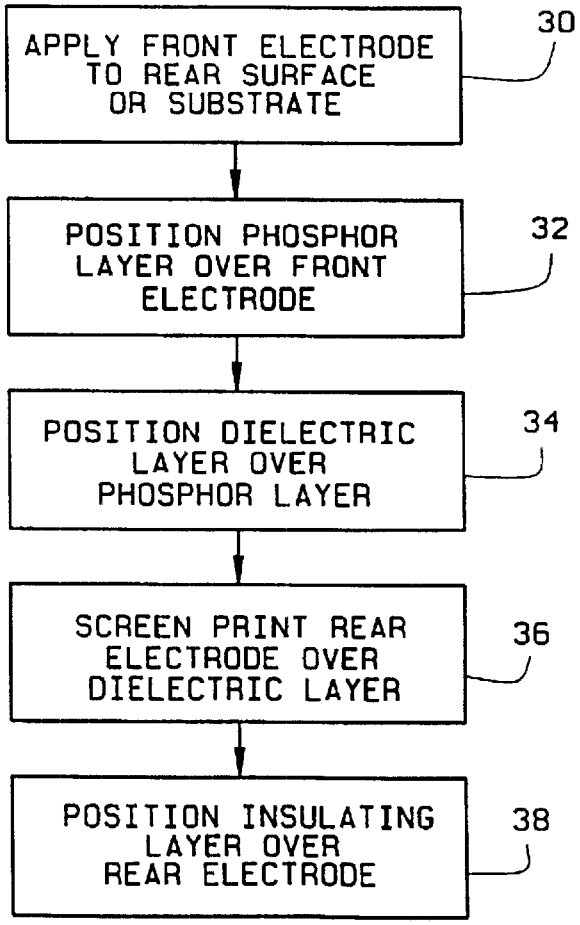
FIG. 2 is a flow chart illustrating a known sequence of steps for fabricating the electroluminescent lamp shown in FIG. 1.

Referring now to FIG. 2, EL lamp 10 typically is fabricated by applying 30 front electrode 14, e.g., indium tin oxide, to a rear surface of substrate 12. For example, indium tin oxide may be sputtered onto the polyester film. Phosphor layer 16 then is positioned 32 over front electrode 14, and dielectric layer 18 is positioned 34 over phosphor layer 16. Rear electrode 20 is then screen printed 36 over dielectric layer 18, and insulating layer 22 is positioned 38 over rear electrode 20 to substantially prevent possible shock hazard or to provide a moisture barrier to protect lamp 10. The various layers may, for example, be laminated together utilizing heat and pressure.

As explained above, to fabricate an illuminated sign having an EL lamp utilizing known methods, it is necessary to prefabricate the EL lamp, and then to couple the prefabricated EL lamp to the sign. Particularly, the insulating layer, e.g., insulating layer 22, of the prefabricated lamp is bonded to a front surface of the sign so that when a voltage is applied across the front and rear electrodes, the phosphor material is activated and emits a light which is visible through the polyester film. Coupling a prefabricated EL lamp to a sign is tedious and requires fabricating the EL lamp as a reverse image.

Figure 3:
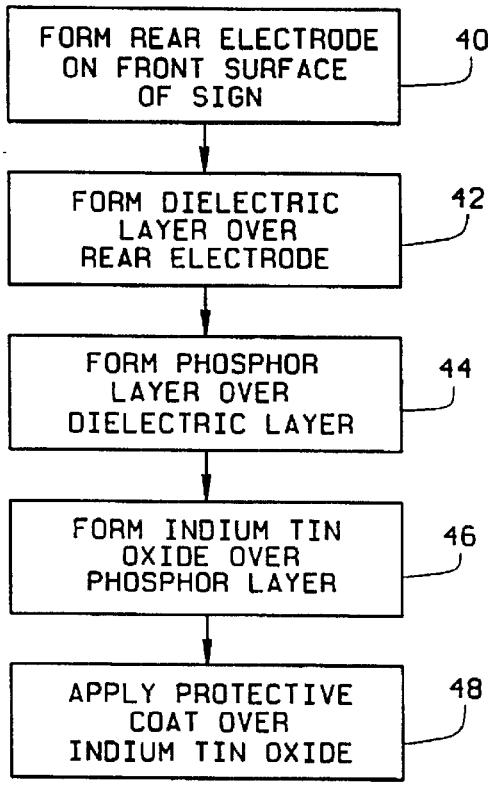
FIG. 3 is a flow chart illustrating a sequence of steps for fabricating a sign including an EL lamp in accordance with one embodiment of the present invention.

FIG. 3 illustrates a sequence of steps for fabricating an illuminated sign including an EL lamp in accordance with one embodiment of the present invention. The sign may, for example, have a metal substrate, e.g. 0.25 mm gauge aluminum, a plastic substrate, e.g., 0.15 mm heat stabilized polycarbonate, or a cardboard substrate, e.g., 50 pt. board. With respect to a 0.25 mm gauge aluminum sign, a rear electrode is formed 40 on a front surface of the sign. The rear electrode is formed of conductive particles, e.g., silver or carbon, dispersed in a polymeric binder to form a screen printable ink, such as #7145 HDP217, which is commercially available from DuPont Electronics, Research Triangle Park, N.C. Next, a dielectric layer is formed 42 over the rear electrode. The dielectric layer is formed of high dielectric constant material, such as barium titanate dispersed in a polymeric binder, which also is commercially available from DuPont Electronics, Research Triangle Park, N.C. Subsequently, a phosphor layer of electroluminescent phosphor particles, e.g., zinc sulfide doped with copper or manganese which are dispersed in a polymeric binder, is formed 44 over the dielectric layer. A layer of indium tin oxide ink is then formed 46 over the phosphor layer, and a protective coat is applied 48 over the indium tin oxide ink.

Figure 4:
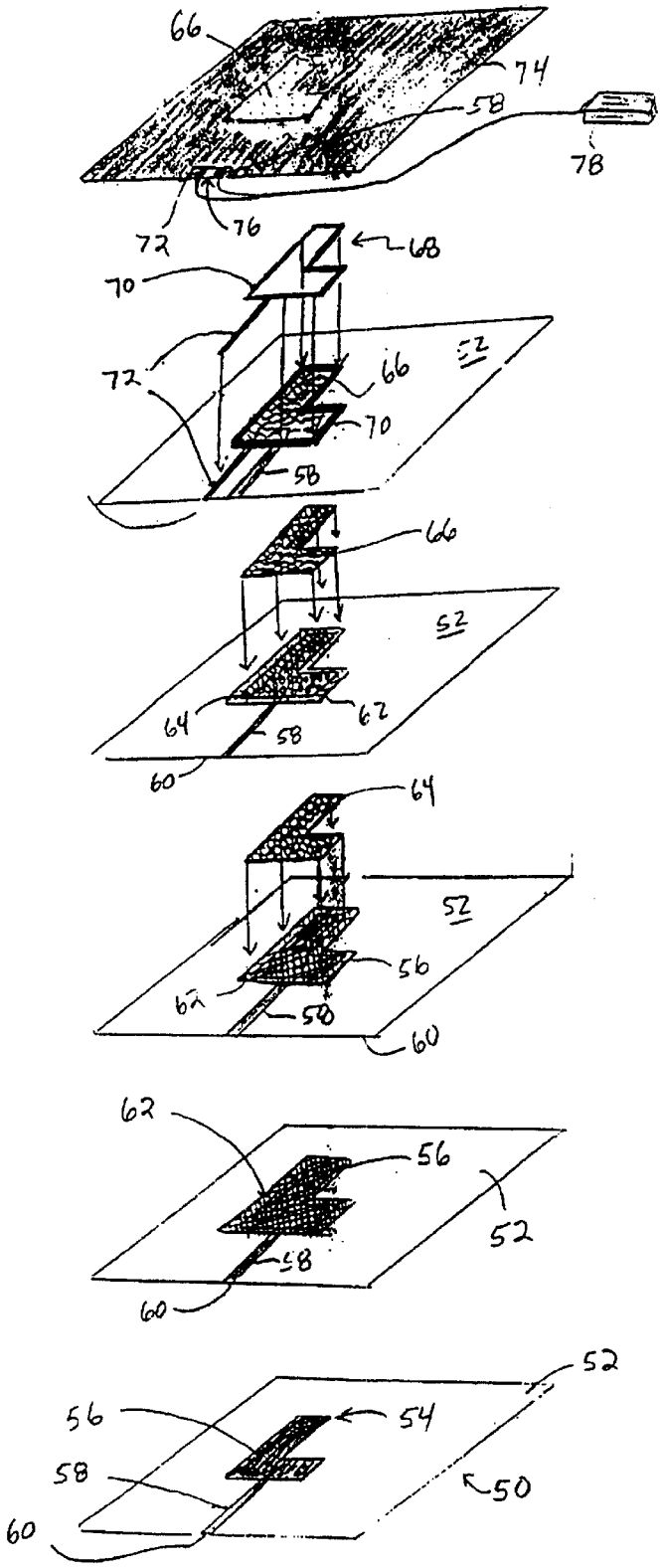
FIG. 4 is an exploded pictorial illustration of a sign including an EL lamp fabricated in accordance with the steps shown in FIG. 3.

More particularly, and referring now to FIG. 4, a metallic sign 50, e.g., a sign having a metal substrate, having a front surface 52 and a rear surface (not shown in FIG. 4) is first positioned in an automated flat bed screen printing press (not shown in FIG. 4). A rear electrode 54, such as screen printable carbon or silver, having an illumination area 56 and a rear electrode lead 58 is then screen printed onto front surface 52 of sign 50. Illumination area 56 defines a light emitting design, or shape, e.g., an "L", representative of the ultimate image to be illuminated on sign 50. Rear electrode lead 58 extends from illumination area 56 to a perimeter 60 of sign front surface 52. Rear electrode 54 is screen printed as a positive, or forward, image, e.g., as "L" rather than as a reverse "L". After printing rear electrode 54 on front surface 52, rear electrode 54 is cured to dry. For example, rear electrode 54 and sign 50 may be positioned in a reel to reel oven for approximately two minutes at a temperature of about 350 degrees Fahrenheit.

A dielectric layer 62 is then screen printed onto sign surface 52 so that dielectric layer 62 covers substantially the entire illumination area 56 while leaving rear electrode lead 58 substantially uncovered. Particularly, dielectric layer 62 includes two layers (not shown) of high dielectric constant material, such as barium titanate dispersed in a polymeric binder. The first layer of barium titanate is screen printed over rear electrode 54 and then cured to dry for approximately two minutes at a temperature of about 350 degrees Fahrenheit. The second layer of barium titanate is then screen printed over the first layer of barium titanate and cured to dry for approximately two minutes at a temperature of about 350 degrees Fahrenheit to form dielectric layer 62. In accordance with one embodiment, dielectric layer 62 has substantially the same shape as illumination area 56, but is approximately 2% larger than illumination area 56.

After screen printing dielectric layer 62 and rear electrode 54 to sign surface 52, a phosphor layer 64 is screen printed onto sign surface 52 over dielectric layer 62. Phosphor layer 64 is screened as a forward, or positive, image, e.g., as "L", rather than a reverse image, e.g., as a reverse image of "L", and has substantially the same shape and size as illumination area 56. Phosphor layer 64 may, for example, be screen printed to sign 50 with the same screen utilized to print rear electrode 54 to sign 50. Phosphor layer 64 is then cured, for example, for approximately two minutes at about 350 degrees Fahrenheit.

An indium tin oxide layer 66 is then screen printed over phosphor layer 64. Indium tin oxide layer 66 has substantially the same shape and size as illumination area 56 and may, for example, be screen printed with the same screen utilized to print phosphor layer 64. Indium tin oxide layer 66 also is screened as a forward image and is cured, for example, for approximately two minutes at about 350 degrees Fahrenheit.

Subsequently, a front electrode, or bus bar, 68 fabricated from silver ink is screen printed onto sign surface 52 and configured to transport energy to indium tin oxide layer 66. Particularly, front electrode 68 is screen printed to sign surface 52 so that a first portion 70 of front electrode 68 contacts the outer perimeter of indium tin oxide layer 66, and thus the outer perimeter of illumination area 56, and a front electrode lead 72 extends from illumination area 56 to perimeter 60 of sign surface 52. Front electrode 68 is then cured for approximately two minutes at about 350 degrees Fahrenheit. Rear electrode 54, dielectric layer 62, phosphor layer 64, indium tin oxide layer 66, and front electrode 68 form an EL lamp extending from surface 52 of sign 50.

A background layer 74 is then screen printed on front surface 52 of sign 50. Background layer 74 substantially covers front surface 52 except for illumination area 56 and a terminal tab portion 76 of front surface 52. Particularly, background layer 74 substantially covers front electrode 68, the portion of dielectric layer 62 not aligned with illumination area 56, and rear electrode 54. Terminal tab portion 76 is adjacent sign perimeter 60 and is uncovered to facilitate coupling a power supply 78 to front electrode lead 72 and rear electrode lead 58. Particularly, background layer 74 is screen printed on front surface 52 so that substantially only background layer 74 and indium tin oxide layer 66 are visible from a location facing front surface 52. Background layer 74 may include, for example, conventional UV screen printing ink and may be cured in a UV dryer utilizing known sign screening practices.

Sign 50 may then be embossed so that sign front surface 52 is not planar. Particularly, sign 50 may be embossed so that illumination area 56 projects forward with respect to sign perimeter 60. Alternatively, sign 50 may be embossed so that one portion of illumination area 56, e.g., the short leg of "L", projects forward with respect to another portion or illumination area 56, e.g., the long leg of "L". For example, sign 50 may be positioned in a metal press configured to deliver five tons of pressure per square inch to form dimples in sign front surface 52.

After applying rear electrode 54, dielectric layer 62, phosphor layer 64, indium tin oxide layer 66, front electrode 68, and background layer 74 to sign 50, sign may, for example, be hung in a window, on a wall, or suspended from a ceiling. Power supply 78 is then coupled to front electrode lead 72 and rear electrode lead 58 and applies a voltage across rear electrode 54 and front electrode 68 to activate phosphor layer 64. Particularly, current is transmitted through front electrode 68 to indium tin oxide layer 66, and through rear electrode 54 to illumination area 56 to illuminate the letter "L".

In accordance with one embodiment, rear electrode 54 is approximately 0.6 millimeters thick, dielectric layer 62 is approximately 1.2 millimeters thick, phosphor layer 64 is approximately 1.6 millimeters thick, indium tin oxide layer 66 is approximately 1.6 millimeters thick, front bus bar 68 is approximately 0.6 millimeters thick, and background layer 74 is approximately 0.6 millimeters thick. Of course, each of the various thicknesses may vary.

The above described method provides an illuminated sign having an EL lamp but does not require coupling a prefabricated EL lamp to the sign. Such method also facilitates applying each layers of the EL lamp to the EL substrate as a positive image, rather than a reverse image. However, the above described embodiment is exemplary, and is not meant to be limiting. For example, after screening background layer 74 onto front surface 52, an ultraviolet (UV) coating may be applied to sign 50. Particularly, the UV coating may be applied to cover entire front surface 52 of sign 50 and to provide protection to the EL lamp formed by rear electrode 54, dielectric layer 62, phosphor layer 64, indium tin oxide layer 66, and front electrode 68.

Similarly, front surface 52 of sign 50 may be coated with a UV coating before applying rear electrode 54 to front surface 52. For example, if sign 50 is a cardboard sign, then a UV coating is first applied to front surface 52 to substantially ensure the integrity of the EL lamp layers, e.g., to substantially prevent the cardboard substrate from absorbing the screen printable inks.

Figure 5:
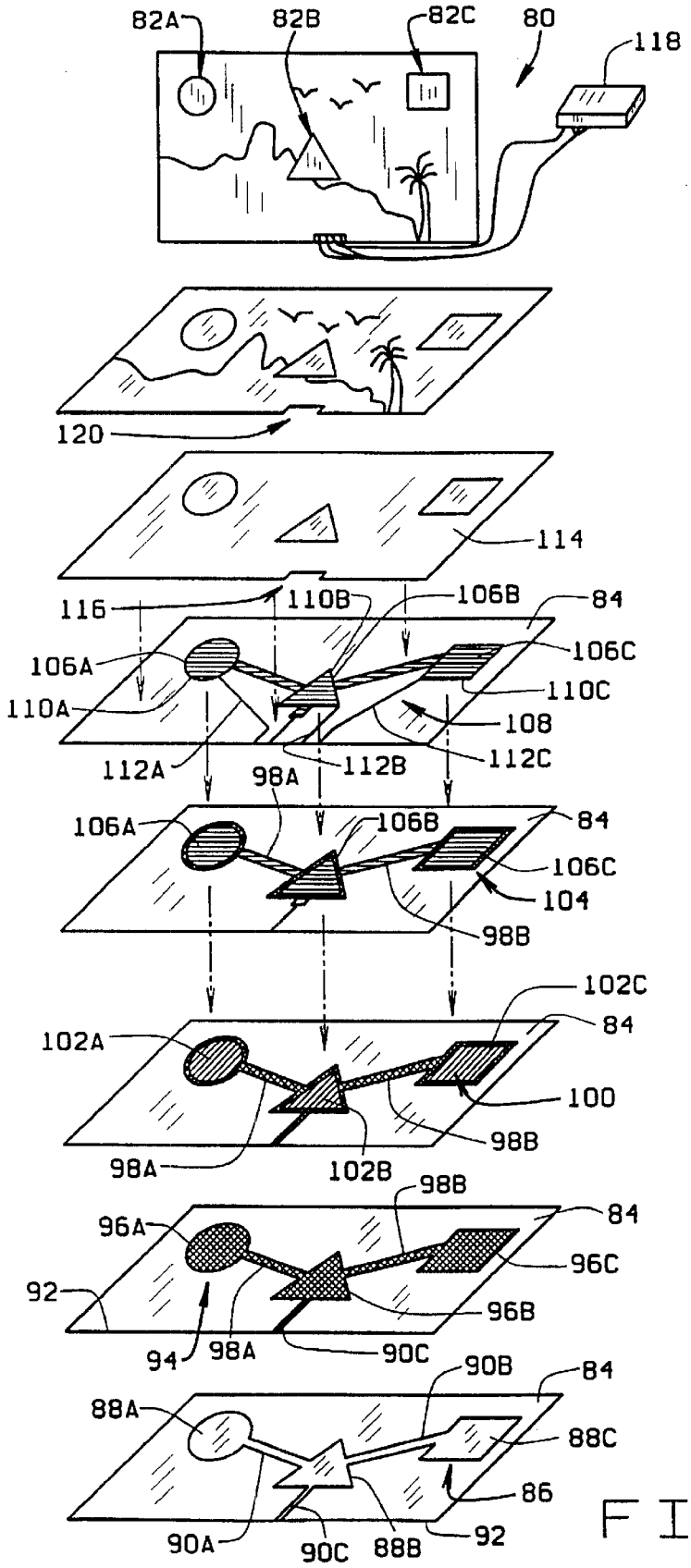
FIG. 5 is an exploded pictorial illustration of a sign including three EL lamps fabricated in accordance with the steps shown in FIG. 3.

In accordance with another embodiment of the present invention, a sign is provided which includes several EL lamps. For example, FIG. 5 is an exploded pictorial illustration of a metallic sign 80 having three EL lamps 82A, 82B, and 82C configured as a circle, a triangle, and a square, respectively. Sign 80 includes a front surface 84 and a rear surface (not shown in FIG. 5) and is first positioned in an automated flat bed screen printing press (not shown in FIG. 5). A rear electrode 86, such as screen printable carbon or silver, having three illumination areas 88A, 88B, and 88C, and three rear electrode leads 90A, 90B, and 90C is then screen printed onto front surface 84 of sign 80. Illumination area 88A defines a light emitting design, or shape, e.g., a circle, representative of the ultimate image to be illuminated by EL lamp 82A on sign 80. Illumination area 88B defines a light emitting design, or shape, e.g., a triangle, representative of the ultimate image to be illuminated by EL lamp 82B on sign 80. Illumination area 88C defines a light emitting design, or shape, e.g., a square, representative of the ultimate image to be illuminated by EL lamp 82C on sign 80. Rear electrode lead 90A extends between illumination area 88A and illumination area 88B. Rear electrode lead 90B extends between illumination area 88B and illumination area 88C. Rear electrode lead 90C extends from illumination area 88B to a perimeter 92 of sign front surface 84. Rear electrode 86 is screen printed as a positive, or forward, image. After printing rear electrode 86 on front surface 84, rear electrode 86 is cured to dry.

A dielectric layer 94 is then screen printed onto sign surface 84 so that dielectric layer 94 substantially covers rear electrode 86 while leaving a portion of rear electrode lead 90 substantially uncovered. Particularly, dielectric layer 94 includes two layers (not shown) of high dielectric constant material, such as barium titanate dispersed in a polymeric binder. The first layer of barium titanate is screen printed over rear electrode 86 and then cured to dry for approximately two minutes at a temperature of about 350 degrees Fahrenheit. The second layer of barium titanate is then screen printed over the first layer of barium titanate and cured to dry for approximately two minutes at a temperature of about 350 degrees Fahrenheit to form dielectric layer 94. In accordance with one embodiment, dielectric layer 94 has three illumination portions 96A, 96B, and 96C which are substantially the same shape as, and approximately 2% larger than, respective illumination areas 88A, 88B, and 88C. In addition, dielectric layer 94 includes two lead portions 98A and 98B sized to cover rear electrode leads 90A and 90B, respectively.

After screen printing dielectric layer 94 and rear electrode 86 to sign surface 84, a phosphor layer 100 is screen printed onto sign surface 84 over dielectric layer 94. Phosphor layer 100 includes three portions 102A, 102B, and 102C, respectively, which are substantially the same shape and size as illumination areas 88A, 88B and 88C, respectively. Phosphor layer 100 may, for example, be screen printed to sign 80 with the same screen utilized to print rear electrode 86 to sign 80. Phosphor layer 100 is then cured, for example, for approximately two minutes at about 350 degrees Fahrenheit.

An indium tin oxide layer 104 is then screen printed over phosphor layer 100. Indium tin oxide layer 104 includes three portions 106A, 106B, and 106C, respectively, which have substantially the same shape and size as illumination areas 88A, 88B, and 88C, respectively. Indium tin oxide layer 104 may, for example, be screen printed with the same screen utilized to print phosphor layer 100. Indium tin oxide layer 104 also is screened as a forward image and is cured, for example, for approximately two minutes at about 350 degrees Fahrenheit.

Subsequently, a front electrode, or bus bar, 108 fabricated from silver ink is screen printed onto sign surface 84 and configured to transport energy to indium tin oxide layer 104. Particularly, front electrode 108 is screen printed to sign surface 84 so that a first portion 110A of front electrode 108 contacts the outer perimeter of indium tin oxide layer portion 106A, a second portion 110B contacts the outer perimeter of indium tin oxide layer portion 106B, and a third portion 110C contacts the outer perimeter of indium tin oxide layer portion 106C. First portion 110A includes a front electrode lead 112A which extends from illumination area 88A to perimeter 92 of sign surface 84. Similarly, second portion 110B includes a front electrode lead 112B which extends from illumination area 88B to perimeter 92 of sign surface 84 and third portion 110C includes a front electrode lead 112C which extends from illumination area 88C to perimeter 92 of sign surface 84. Front electrode 108 is then cured for approximately two minutes at about 350 degrees Fahrenheit. Rear electrode 86, dielectric layer 94, phosphor layer 100, indium tin oxide layer 104, and front electrode 108 form an EL lamp extending from surface 84 of sign 80.

A background layer 114 is then screen printed on front surface 84 of sign 80. Background layer 114 substantially covers front surface 84 except for illumination area 88 and a terminal tab portion 116 of front surface 84. Particularly, background layer 114 substantially covers front electrode 108, the portion of dielectric layer 94 not aligned with illumination areas 88A, 88B, and 88C, and rear electrode 86. Terminal tab portion 116 is adjacent sign perimeter 92 and is uncovered to facilitate coupling a power supply 118 to front electrode lead 112 and rear electrode lead 90. Particularly, background layer 114 is screen printed on front surface 84 so that substantially only background layer 114 and indium tin oxide layer 104 are visible from a location facing front surface 84. Background layer 114 may include, for example, conventional UV screen printing ink and may be cured in a UV dryer utilizing known sign screening practices. Alternatively, background layer 114 may include several conventional U.S. screen printing inks and configured as a design, such as background layer 120.

Sign 80 may then be embossed so that sign front surface 84 is not planar. Particularly, sign 80 may be embossed so that, for example, illumination area 88A projects forward with respect to illumination are 88B. Alternatively, sign 80 may be embossed so that illumination area 88B projects forward with respect to illumination area 88A.

The above described signs include EL lamps but do not require coupling prefabricated EL lamps to the sign. Such signs also are fabricated by screen printing each layer of the EL lamps as a positive image, rather than a reverse image.

Figure 6:
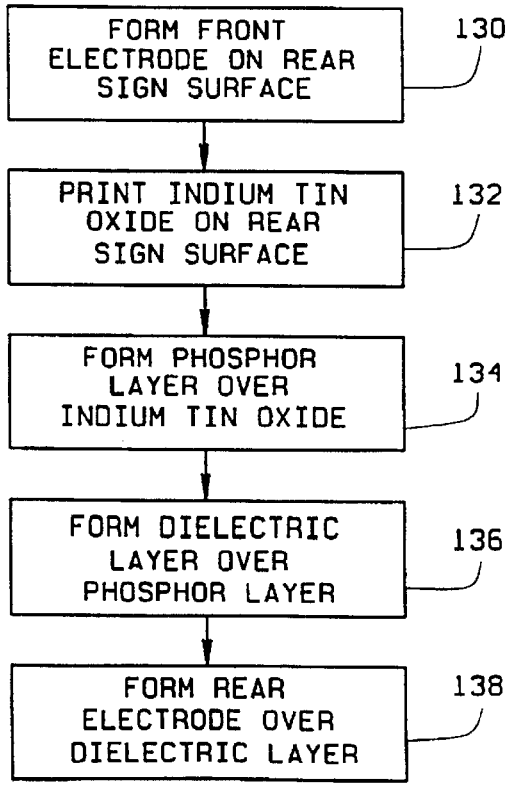
FIG. 6 is a flow chart illustrating a sequence of steps for fabricating a sign including an EL lamp in accordance with another embodiment of the present invention.

In accordance with still yet another embodiment, a plastic sign including EL lamps is provided. Particularly, and referring now to FIG. 6, a front electrode defining an illumination area, e.g., "L" (FIG. 4), is screen printed 130 to a rear surface of a substantially clear plastic sign. After screen printing 130 the front electrode, an indium tin oxide layer is screen printed 132 to the rear surface, and a phosphor layer is screen printed 134 to the indium tin oxide layer. Subsequently, a dielectric layer is screen printed 136 over the phosphor layer. The front electrode and phosphor layer are configured to define a light emitting design. A rear electrode is then screen printed 138 over the dielectric layer to form an EL lamp. Accordingly, the plastic sign includes an EL lamp without requiring a prefabricated EL lamp to be coupled to the sign.

Figure 7:
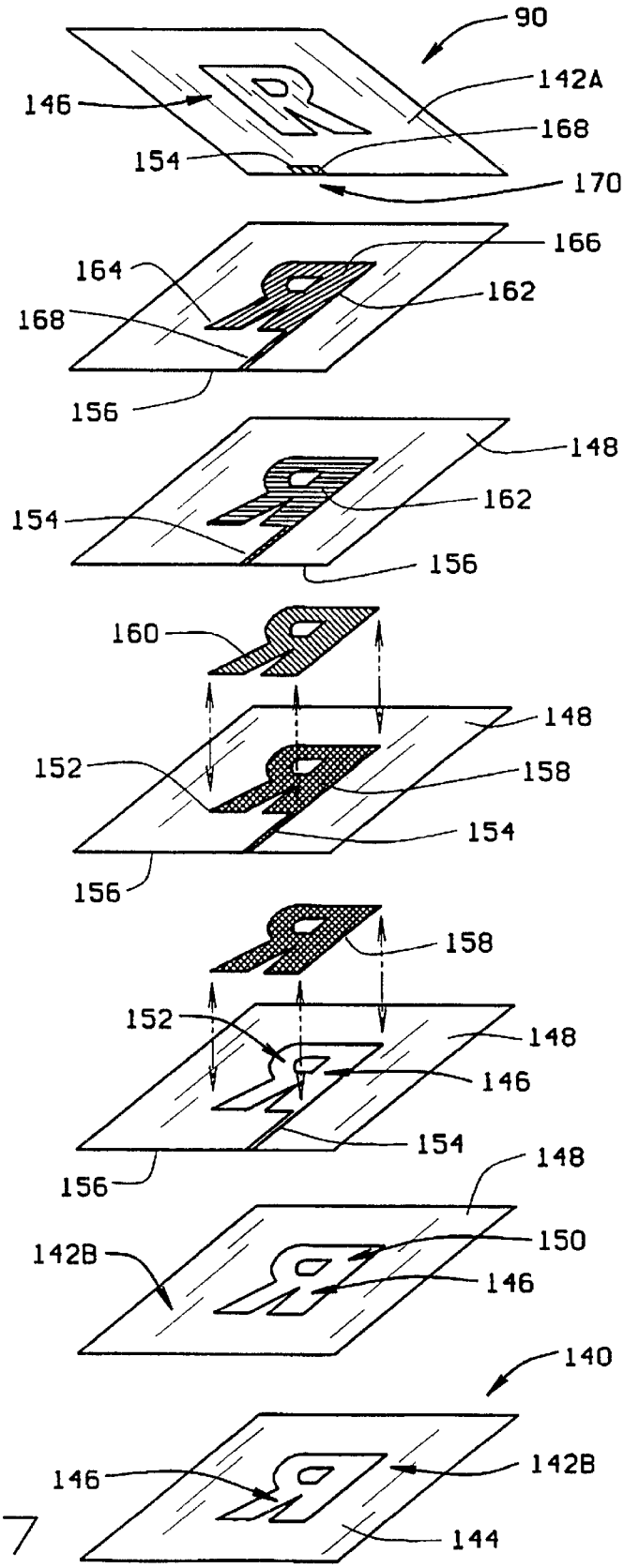
FIG. 7 is an exploded pictorial illustration of a sign including an EL lamp fabricated in accordance with the steps shown in FIG. 6.

More particularly, and referring now to FIG. 7, a substantially clear heat stabilized polycarbonate sign 140, e.g., a sign having a plastic substrate, having a front surface 142A and a rear surface 142B is first positioned in an automated flat bed screen printing press (not shown in FIG. 7). A background substrate 144 is screen printed to rear surface 142B and covers substantially entire rear surface 142B except for an illumination area 146 thereof. Illumination area 146 is shaped as a reverse image, e.g., a reverse image of "R", of a desired image to be illuminated, e.g., an "R".

A dielectric background layer 148 is then screen printed over sign rear surface 142B and background substrate 144. Dielectric background layer 148 covers substantially entire background substrate 144 and includes an illumination portion 150 which is substantially aligned with illumination area 146.

A front electrode 152 fabricated from silver ink is then screen printed onto sign rear surface 142B so that front electrode 152 contacts the outer perimeter of illumination portion 150. In addition, a lead 154 of front electrode 152 extends from the perimeter of illumination portion 150 to a perimeter 156 of sign 140. Front electrode 152 is then cured for approximately two minutes at about 350 degrees Fahrenheit.

Subsequently, an indium tin oxide layer 158 is screen printed onto rear sign surface 142B. Indium tin oxide layer 158 is the same size and shape as illumination area 146 and is screen printed as a reverse image, e.g., a reverse image of "R", onto illumination area 146 of rear sign surface 142B. Indium tin oxide layer 158 is then cured, for example, for approximately two minutes at about 350 degrees Fahrenheit.

After screen printing indium tin oxide layer 158 to sign surface 142B, a phosphor layer 160 is screen printed over indium tin oxide layer 158. Phosphor layer 160 is screened as a reverse image and has substantially the same shape and size as indium tin oxide layer 158. Phosphor layer 160 may, for example, be screen printed to sign 140 with the same screen utilized to print indium tin oxide layer 158. Phosphor layer 160 is then cured, for example, for approximately two minutes at about 350 degrees Fahrenheit.

A dielectric layer 162 is then screen printed onto sign surface 142B so that dielectric layer 162 covers substantially entire phosphor layer 160 and front electrode 152. Particularly, and as explained above with respect to dielectric layers 94 and 62, dielectric layer 162 includes two layers (not shown) of high dielectric constant material, such as barium titanate dispersed in a polymeric binder. The first layer of barium titanate is screen printed over phosphor layer 160 and then cured to dry for approximately two minutes at a temperature of about 350 degrees Fahrenheit. The second layer of barium titanate is then screen printed over the first layer of barium titanate and cured to dry for approximately two minutes at a temperature of about 350 degrees Fahrenheit to form dielectric layer 162. In accordance with one embodiment, dielectric layer 162 has substantially the same shape as illumination area 146, but is approximately 2% larger than illumination area 146 and is sized to cover at least a portion of front electrode lead 154.

A rear electrode 164 is screen printed to rear surface 142B over dielectric layer 162 and includes and illumination portion 166 and a rear electrode lead 168. Illumination portion 166 is substantially the same size and shape as illumination area 146, and rear electrode lead 168 extends from illumination portion 166 to sign perimeter 156. Rear electrode 164 may be formed from, for example, screen printable carbon. Rear electrode 164, dielectric layer 162, phosphor layer 160, indium tin oxide layer 158, and front electrode 152 form an EL lamp extending from rear surface 142B of sign 140.

Subsequently, a UV clear coat (not shown in FIG. 7) is screen printed to rear surface 142B and covers rear electrode

164, dielectric layer 162, phosphor layer 160, indium tin oxide layer 158, front electrode 152, dielectric background layer 148 and background layer 144. Particularly, the UV clear coat covers substantially entire rear surface 142B except for a terminal portion 170, through which a portion of front electrode lead 154 and rear electrode lead 168 are exposed to facilitate coupling a power supply (not shown in FIG. 7) to such leads 154 and 168. Sign may then, for example, be hung in a window, on a wall, or suspended from a ceiling so that illumination area 146 is a positive image, e.g., "R", when viewed from a location adjacent front surface 142A of sign 140.

The above described method provides an illuminated plastic sign having an EL lamp but does not require coupling a prefabricated EL lamp to the sign. In addition, flat EL sign 140 may be vacuum formed into a substantially three dimensional shape. For example, sign 140 may placed on top of a mandrel form and may then be vacuum formed in accordance with known vacuum forming techniques.

The previous discussion refers specifically to methods for providing illuminated signs having at least one EL lamp. However, it is to be understood that such methods may be utilized to provide products other than illuminated signs. For example, such methods may be utilized to fabricate illuminated microshells for bicycle helmets or motorcycle helmets and three dimensional shaped signs.

From the preceding description of the present invention, it is evident that the objects of the invention are attained. Although the invention has been described and illustrated in detail, it is to be clearly understood that the same is intended by way of illustration and example only and is not be taken by way of limitation. For example, while the above described signs included only one or two EL lamps, such signs may include more than two, e.g., three, four, five, or even more, EL lamps. In addition, while the methods were described in connection in fabricating signs having EL lamps, such methods may also be utilized to fabricate other products having EL lamps. Accordingly, the spirit and scope of the invention are to be limited only by the terms of the appended claims.

What is claimed is:

1. A sign comprising a surface and an illuminated design coupled thereto, said illuminated design comprising:

a first electrode formed on said sign surface;

a phosphor layer substantially aligned with said first electrode and screen printed on said sign surface;

an indium tin oxide layer substantially aligned with said phosphor layer and screen printed on said phosphor layer, said indium tin oxide layer defining an outer perimeter; and a second electrode screen printed onto said sign surface, said second electrode substantially circumscribing the outer perimeter of the tin oxide layer and configured to transport energy to said indium tin oxide layer.

2. A sign in accordance with claim 1 where said first electrode comprises a rear electrode, and wherein said rear electrode is screen printed on said substrate as a forward image.

3. A sign in accordance with claim 1 wherein said second electrode is a front electrode, and wherein said front electrode is screen printed on said sign surface as a forward image.

4. A sign in accordance with claim 1 wherein said second electrode includes a first portion, said second electrode being screen printed on said sign surface such that said first portion of said second electrode contacts an outer perimeter of said indium tin oxide layer.

* * * * *

UNITED STATES PATENT AND TRADEMARK OFFICE

CERTIFICATE OF CORRECTION

PATENT NO. : 6,424,088 B1
DATED : July 23, 2002
INVENTOR(S) : Matthew M. Murasko It is certified that error appears in the above-identified patent and that said Letters Patent is hereby corrected as shown below:

Title page,
Item [73], Assignee, delete "MS" and insert therefor -- MO --.

Signed and Sealed this

Fourth Day of March, 2003

JAMES E. ROGAN
*Director of the United States Patent and Trademark Office*